US005906127A

United States Patent [19]

Nakamura

[11] Patent Number: 5,906,127

[45] Date of Patent: May 25, 1999

[54] METHOD AND APPARATUS FOR FORMING INTERNAL SPLINE RING

[75] Inventor: Migiei Nakamura, Hiroshima, Japan

[73] Assignee: Mazda Motor Corporation, Hiroshima, Japan

[21] Appl. No.: 08/898,474

[22] Filed: Jul. 22, 1997

[30] Foreign Application Priority Data

Jul. 25, 1996 [JP] Japan ..... 8-196040

[51] Int. Cl.[6] ..... B21H 5/02

[52] U.S. Cl. ..... 72/85; 72/109; 72/110

[58] Field of Search ..... 72/84, 85, 109, 72/110, 77, 78, 96

[56] References Cited

U.S. PATENT DOCUMENTS 3,181,329 5/1965 Sporck ..... 72/85
4,313,328 2/1982 Janssen et al. ..... 72/283
4,854,148 8/1989 Mayer ..... 72/283
4,884,427 12/1989 Sawahata et al. ..... 72/109

FOREIGN PATENT DOCUMENTS 62-144836 6/1987 Japan .

*Primary Examiner*—Lowell A. Larson
*Attorney, Agent, or Firm*—Sixbey, Friedman, Leedom & Ferguson; Donald R. Studebaker

[57] ABSTRACT

An internal spline ring having an internal root circle diameter D1 and an internal tip diameter D2 is formed by axially press-driving an externally splined mandrel having an external tip diameter equal to the internal root circle diameter, which has a shape supplementarily mating with the internal spline ring, into a half-finished annular member having an internal diameter smaller than the internal tip diameter while pressing radially the half-finished annular member against the mandrel.

17 Claims, 6 Drawing Sheets

METHOD AND APPARATUS FOR FORMING INTERNAL SPLINE RING

BACKGROUND OF THE INVENTION

1. Field of the Invention

This invention relates to a method of and apparatus for forming an internal spline annular member such as an internal spline ring engageable with a splined shaft and an internal gear used as one of elementary gears of a planetary gear mechanism.

2. Description of Related Art

Typically, splines of an internal spline ring engageable with a splined shaft is cut by use of a spline broach. It is also typical to form an internal spline ring in a form rolling method where an annular member is pressed and deformed between an inner spline forming roller and outer backup rollers. One of such form rolling methods is known from, for example, Japanese Unexamined Patent Publication No. 62-144836. Forming or cutting splines by use of a spline broach is relatively unsuitable for small-sized splines and, in addition, defective in forming splines having high strength. In cases where a spline form roller is used to form splines, an internal spline ring having a small module makes it hard to fill the space of the spline form roller sufficiently with flowing material of the ring member, resulting in imprecise forms of spline.

In cases where forging dies are used to form an internal spline ring in cold working, it is needed to apply surface treatment, such as bond coating or surface lubrication treatment and Ti—CN treatment which are costly, to works and dies. Further, the forging die has only short working life in cold working.

SUMMARY OF THE INVENTION

It is an object of the invention to provide a method of and an apparatus for forming an internal spline ring with a precise spline form.

It is another object of the invention to provide a method of and an apparatus for forming an internal spline ring in which material is sufficiently filled in the space of a spline form roller even when the internal spline ring has a small module.

The foregoing objects of the invention is accomplished, in forming an internal spline ring having an internal root circle diameter and an internal tip diameter by use of an externally splined mandrel having an external tip diameter equal to said internal root circle diameter which has a shape supplementarily mating with the internal spline ring, by preparing a half-finished annular member having an internal diameter smaller than the internal tip diameter, and press-driving the mandrel axially into the half-finished annular member while pressing radially the half-finished annular member against the mandrel by press rollers so as to form internal splines on the annular member. While the mandrel is press-driven axially into the half-finished annular member so as to form internal splines on the annular member, the half-finished annular member is preferably rotated. The spline forming press roller is brought into press-contact with the half-finished annular member at commencement of rotation of the half-finished annular member.

In order to continuously press the half-finished annular member radially against the mandrel, the spline forming press roller may press partly the half-finished annular member and be moved in an axial direction in which the mandrel is driven into the half-finished annular member together with the mandrel, or otherwise may press the half-finished annular member over the entire axial length of the half-finished annular member.

The half-finished annular member may be provided by reducing an annular member having an internal diameter between the internal tip diameter of the internal spline annular member by pressing radially the annular member between a cylindrical core rod having an external diameter smaller than the internal tip diameter, which is integral with the externally splined mandrel, and reducing press rollers.

According to the invention, because while the press rollers press down radially an annular member, the externally splined mandrel is press-driven axially into the annular member, the annular member is deformed to precisely profile the splines of the mandrel even when the internal spline annular member has a small module. The utilization of the externally splined mandrel integrally formed with the cylindrical core rod makes it easy to form an internal spline annular member subsequently to providing a half-finished annular member directly from an annular member. Because the externally splined mandrel and cylindrical core rod are integral and coaxial, an annular member always remains coaxial with respect to the mandrel during the step of providing a half-finished annular member and the step of forming an internal spline annular member even though it is radially pressed, an internal spline ring is precisely formed.

BRIEF DESCRIPTION OF THE DRAWINGS

The above and other objects and features of the present invention will be understood from the following description of a specific embodiment thereof when considering in conjunction with the accompanying drawings, in which.

DETAILED DESCRIPTION OF THE SPECIFIC EMBODIMENT

Figure 1:
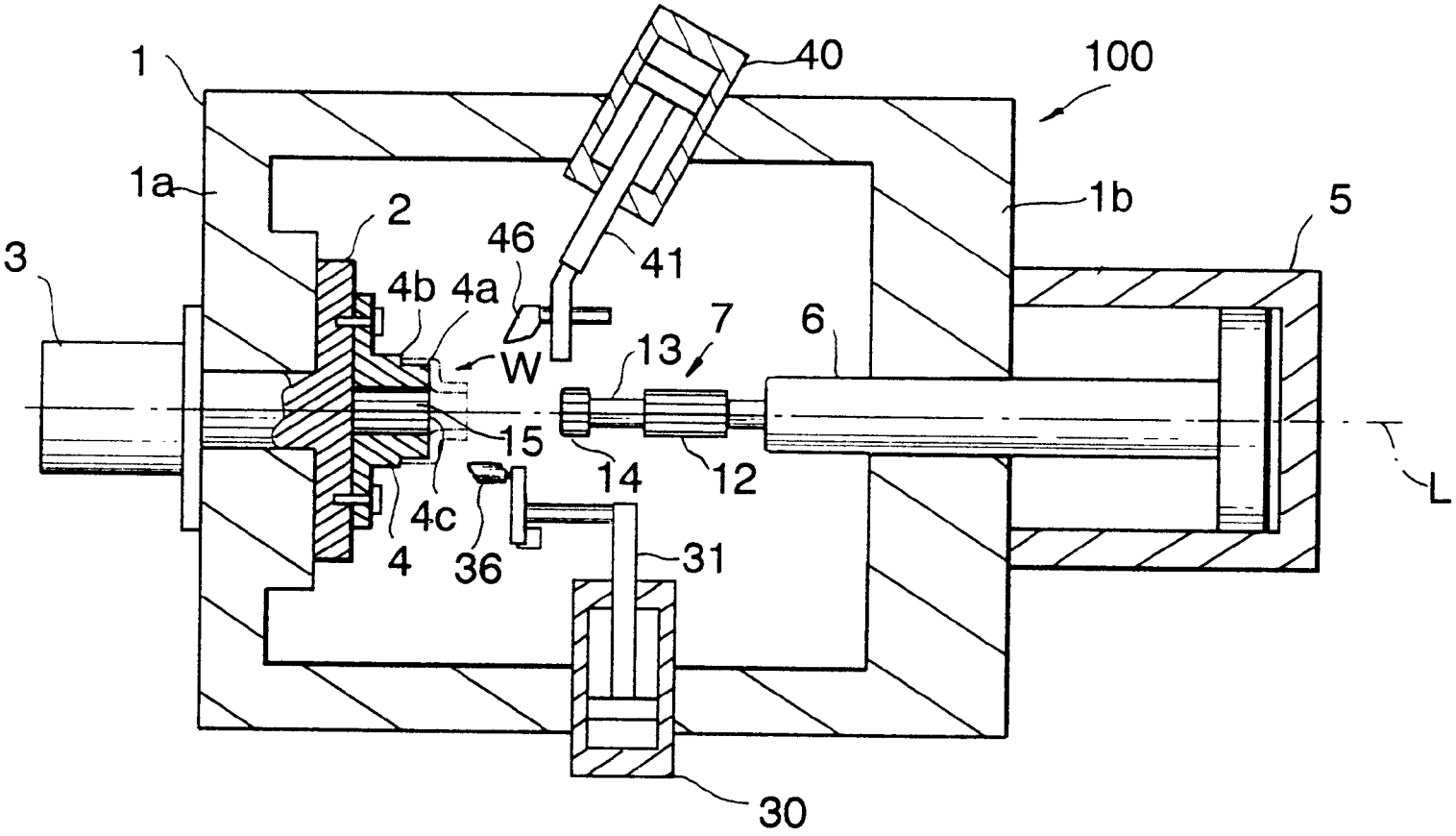
FIG. 1 is a schematic cross-sectional view of an apparatus for forming an internal spline ring according to an embodiment of the invention.

Referring to the drawings in detail, particularly to FIG. 1 which shows a spline forming apparatus 100 for forming internal spline rings, the spline forming apparatus 100 has a frame 1 provided with a motor 3 secured to one of its side walls, namely the left side wall 1*a* as viewed in FIG. 1, and a hydraulic cylinder 5 secured to another one of the side walls, namely the right side wall 1*b*, as viewed in FIG. 1. The frame 1 at the left side wall 1*a* supports a rotary disk table 2 for rotation to which a cylindrical work mount 4 is coaxially secured on which an annular work W is mounted. The motor 3 is connected to the rotary disk table 2 and drives the rotary disk table 2 about a horizontal center axis of rotation L. The frame 1 at the right side wall 1*b* supports a piston 6 of the hydraulic cylinder 5 for axial movement along the rotational center axis L. The piston 6 at its rear end is provided with a mandrel 7 coaxially therewith. The mandrel 7 comprises a splined plunge forming core rod 12 and a splined guide head 14 connected by means of a cylindrical core rod 13 smaller in diameter than the splined plunge forming core rod 12.

Figure 2A:
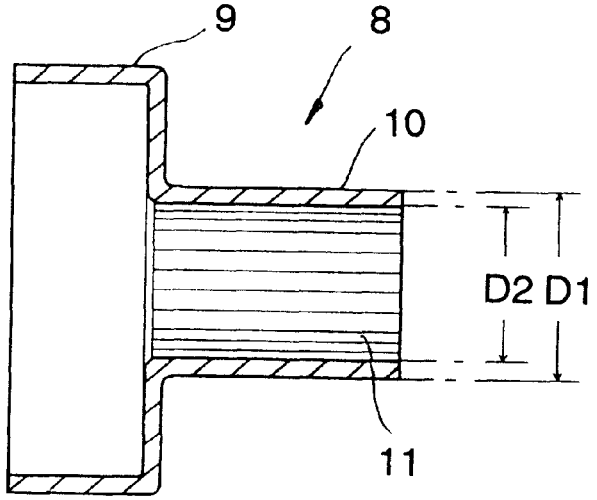
FIG. 2A is a cross-sectional view of an internal spline ring as a finished product.
Figure 2B:
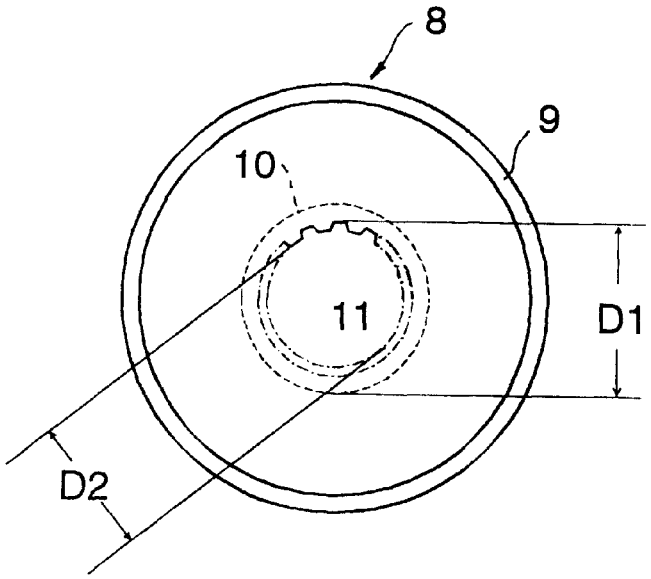
FIG. 2B is a rear view of the internal spline ring.

FIGS. 2A and 2B show, by way of example, a completed splined ring 8 having internal splines 11 which are formed by the spline forming apparatus 100 shown in FIG. 1 as an annular work W. The internal spline ring 8 comprises a cup-like ring section 9 and an internal spline ring section 10 having an outer diameter smaller than the outer diameter of the cup section 9. The internal spline ring section 10 has a plurality of internal splines 11 arranged at regular angles and having a root circle diameter D1 (which is also referred to as an inner diameter of the internal spline ring section 10) and a tip diameter D2.

Figure 3A:
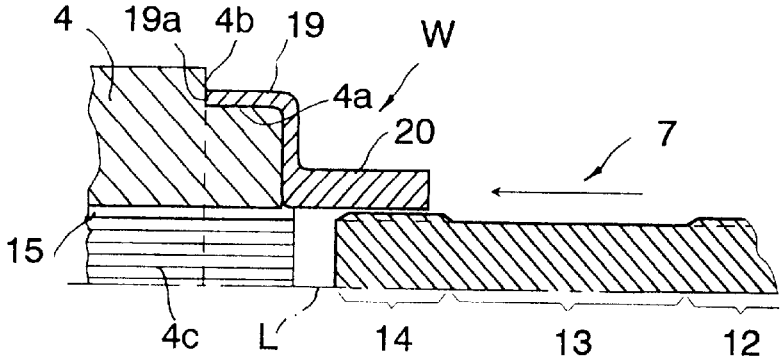
FIGS. 3A through 3C are explanatory views showing a step of providing a half-finished annular member.
Figure 3B:
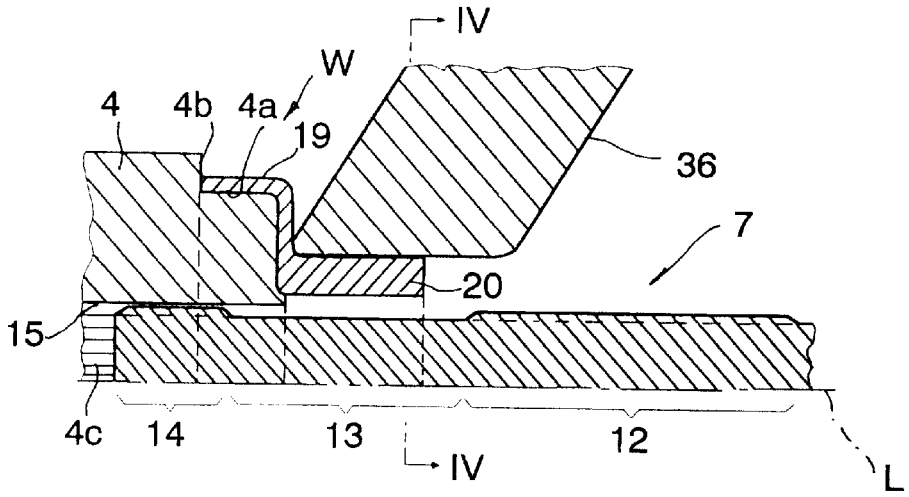
Figure 3C:
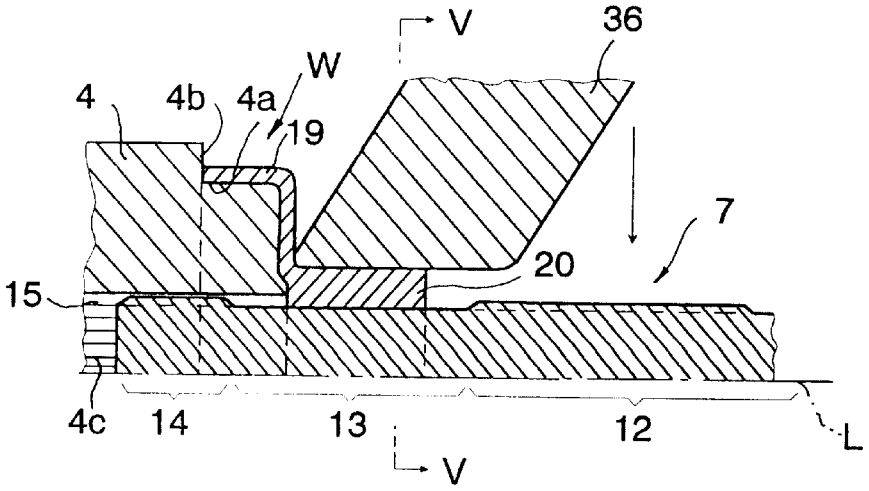
Figure 6A:
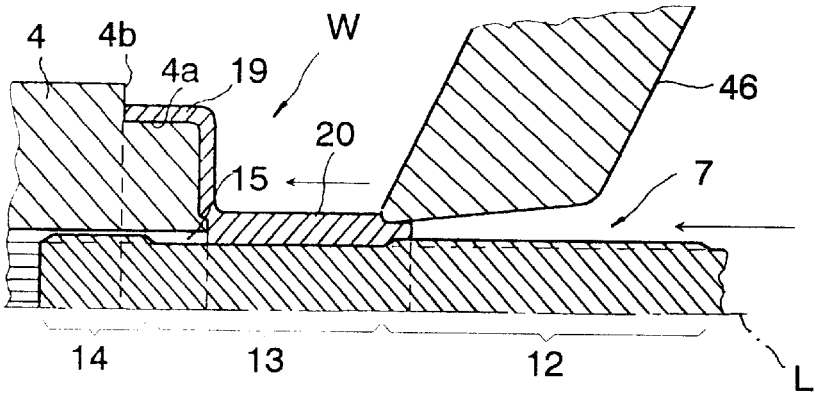
FIGS. 6A through 6C are explanatory views showing a step of forming an internal spline annular member.
Figure 6B:
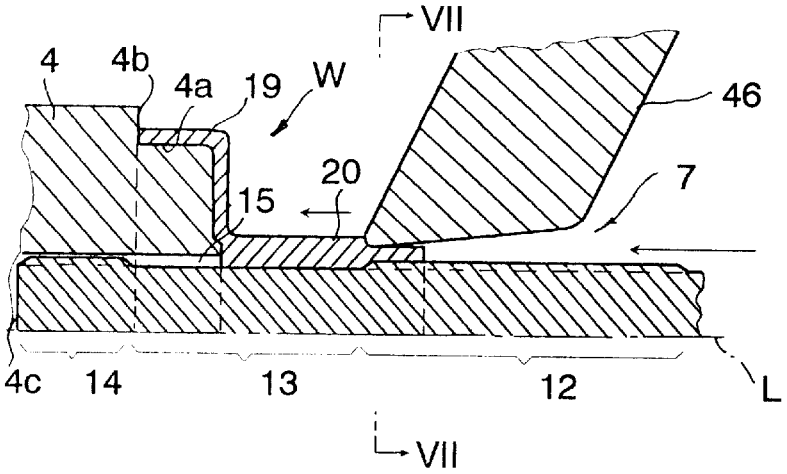
Figure 6C:
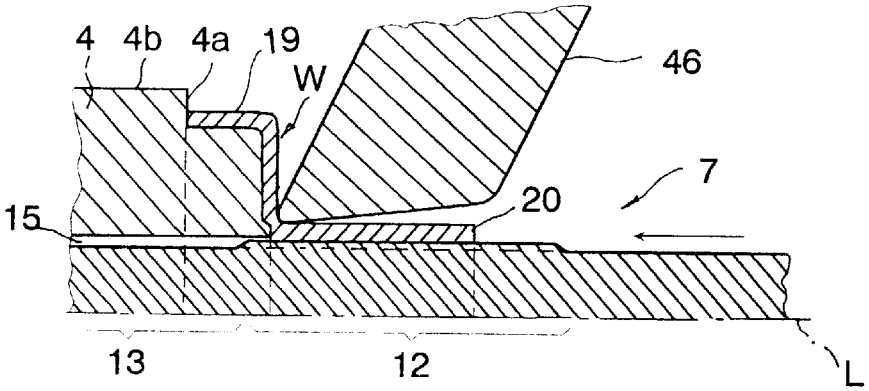

The splined plunge forming core rod 12 has a plurality of external splines mating with the internal splines 11 of the internal spline ring section 10. The cylindrical core rod 13 has a diameter slightly greater than the root circle diameter D1 of the internal spline ring section 10 or approximately equal to the tip diameter D2 of the internal spline ring section 10. The splined guide head 14 has the same number and dimensions of external splines as the splined plunge forming core rod 12. These splined plunge forming core rod 12 and splined guide head 14 have splines in alignment with each other. The work mount 4 has a shoulder by which the work mount 4 is divided into a work mount section 4*a* having a diameter and a height adapted to mount the cup section 9 of the splined ring member 8 thereon and an end support section 4*b* for supporting the splined ring member 8 thereon. The work mount 4 is formed with an axial bore 4*c* formed with internal splines 15 so as to mate with both splined plunge forming core rod 12 and splined guide head 14. The spline forming apparatus 100 is further provided with a plurality of, for example three in this embodiment, reducing press rollers 36, which are supported for rotation by pistons 31 driven by hydraulic cylinders 30, for reducing the annular work W mounted on the work mount 4 in a radial direction in a first step of the spline forming process as shown in FIGS. 3A–3C, and a plurality of, for example two in this embodiment, spline forming press rollers 46, which are supported for rotation by pistons 41 driven by hydraulic cylinders 40, for crushing the wall of the annular work W mounted on the work mount 4 in an axial direction in a second step of the spline forming process as shown in FIGS. 6A–6C. The hydraulic cylinders 30 are arranged around the work mount 4 at regular angles and supported by the frame 1. The cylinders 40 are arranged in diametrically opposite positions with respect to the work mount 4 and supported by the frame 1.

The following description is directed to the spline forming process applied to complete an internal spline ring 8 comprising a cup-like ring section 9 and a spline ring section 10 with a plurality of internal splines 11 arranged at regular angles and having a root circle diameter D1 and a tip diameter D2 shown in FIGS. 2A and 2B.

Figure 4:
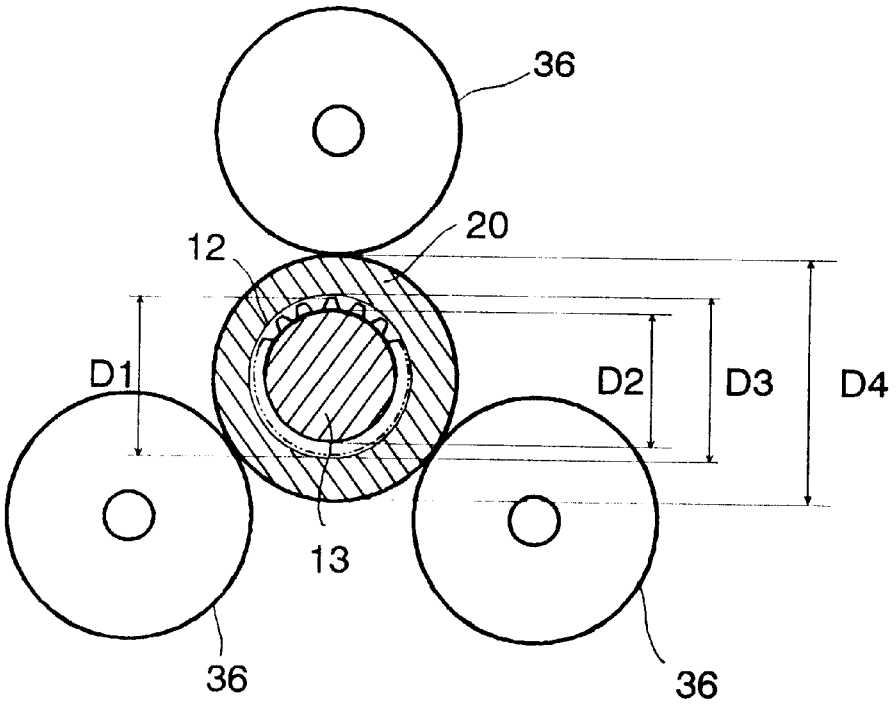
FIG. 4 is a cross-sectional view taken along line IV—IV of FIG. 3B.
Figure 5:
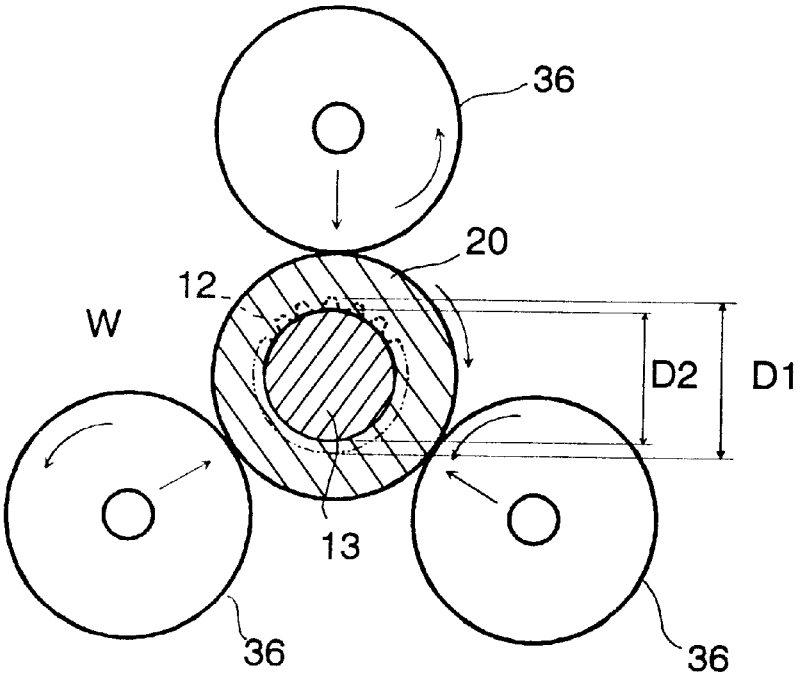
FIG. 5 is a cross-sectional view taken along line V—V of FIG. 3C.

FIGS. 3A–3C show the first step of the spline forming process. An annular work W is provisionally half-finished so as to comprise a cup-like ring section 19 and a ring section 20. As shown in FIG. 4, the ring section 20 has an outer diameter D4 significantly greater than the outer diameter of the internal spline ring section 10 of the internal spline ring 8 and an inner diameter D3 slightly greater than the inner diameter D1 (the root circle diameter of the splines) of the internal spline ring section 10 of the internal spline ring 8. The half-finished annular work W is mounted on the work mount 4 in such a way that the cup-like ring section 19 is fit onto the mount section 4*a* until the rear end 19*a* is brought into abutment against the end support section 4*b*. The hydraulic cylinder 5 forces the mandrel 7 into the inside of the ring section 20 of the annular work W as shown in FIG. 3A until the splined guide head 14 is entirely brought into engagement with the splined axial bore 4*c* of the work mount 4 as shown in FIG. 3B. At this time, the ring section 20 automatically lies over the cylindrical core rod 13 of the mandrel 7 with a radial clearance. The hydraulic cylinders 30 force the pistons 31 to bring the reducing press rollers 36 into firm contact with the outside of the ring section 20 of the annular work W along the entire length as shown in FIGS. 3B and 4. Subsequently, while the hydraulic cylinders 30 force the reducing press rollers 36 to continuously press the ring section 20 of the annular work W in the radial direction, the motor 3 is actuated to rotate the work mount 4. As a result, while the work mount W rotates the annular work W and the mandrel 7 as one whole, the reducing press rollers 36 force down the ring section 20 of the annular work W, reducing the ring section 20 in diameter until the cylindrical core rod 13 of the mandrel 7 is contacted by an inner surface of the ring section 20 as shown in FIGS. 3C and 5. In the first step of the spline forming process, the annular work W thus shaped has an inner diameter D3 approximately equal to the tip diameter D2 of the finished internal spline ring section 10. The ring section 20 of the half-finished annular work W may have an inner diameter at least smaller than the root circle diameter D1 of the internal spline ring section 10 of the finished internal spline ring 8.

Figure 7:
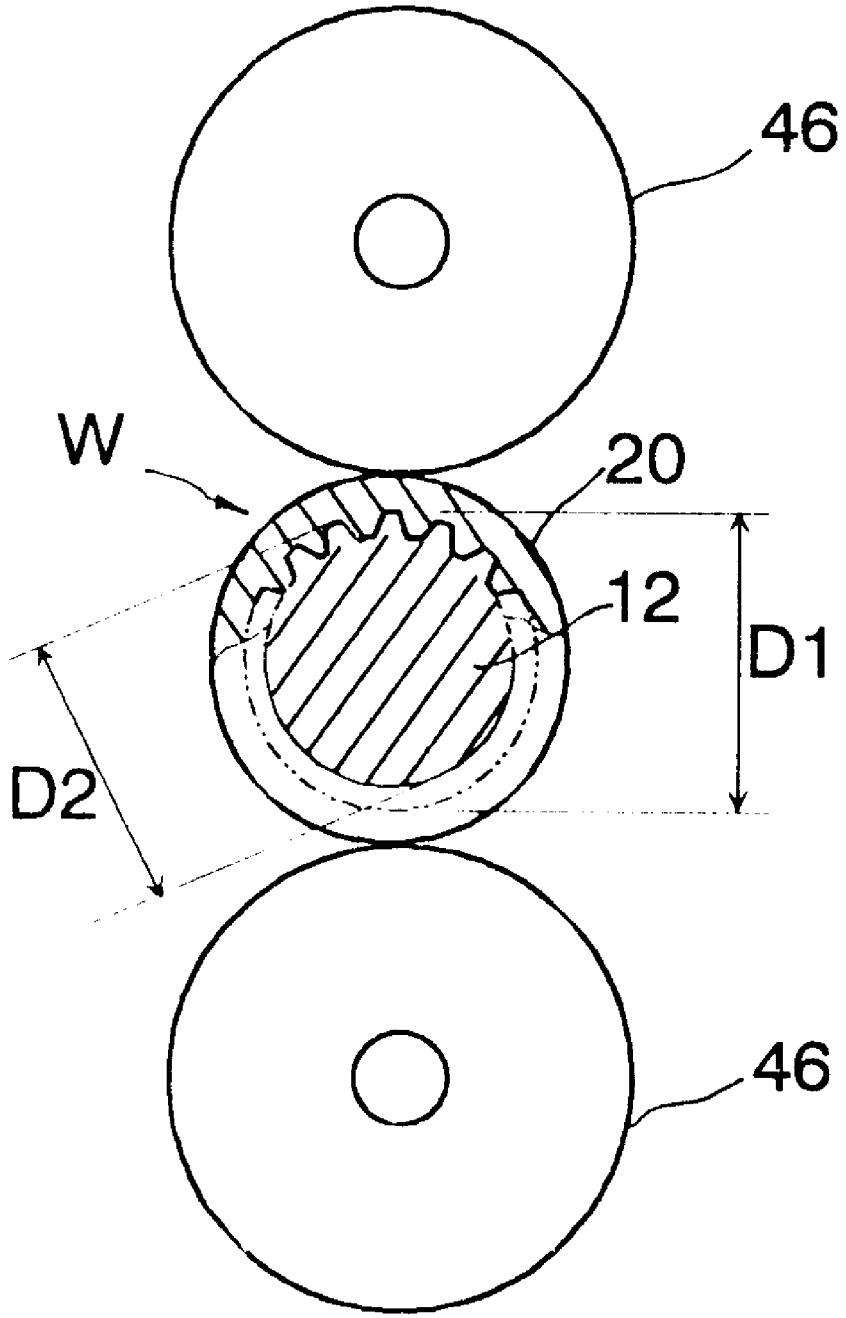
FIG. 7 is a cross-sectional view taken along line VII—VII of FIG. 6B.

In the second step of the spline forming process shown in FIGS. 6A–6C, after causing the hydraulic cylinders 30 to retract the pistons 31 so as to remove the reducing press rollers 36 away from the ring section 20 of the half-finished annular work W, the hydraulic cylinders 40 are actuated to protrude the pistons 41 until the spline forming press rollers 46 are brought into firm contact with the front edge of the reduced ring section 20 of the half-finished annular work W as shown in FIG. 6A. While the motor 3 continuously rotates the work mount 4, and hence the annular work W and the mandrel 7 as one whole, the hydraulic cylinders 5 and 40 protrude their pistons 6 and 41 in an axial direction along the horizontal center axis of rotation L of the work mount 4 to move the spline forming press rollers 46 and the mandrel 7 together, so as to crush the wall of the ring section 20 of the annular work W between the spline forming press rollers 46 and the splined plunge forming core rod 12 of the mandrel 7 as shown in FIGS. 6B and 7 until at least the spline forming press rollers 46 reach the rear end of the ring section 20 of the annular work W as shown in FIG. 6C. The piston 6 is further moved in the axial direction until the leading end of the splined plunge forming core rod 12 is brought into engagement with the splined axial bore 4*c* of the work mount 4. In this way, the annular work W is shaped as the internal spline ring 8.

In the second step of the spline forming process, the spline forming press rollers 46 and the splined plunge forming core rod 12 are controlled to provide a precise distance therebetween and to move at a precisely regulated speed.

The spline forming apparatus 100 may be further provided with idle rollers between each adjacent press rollers 36, 46 so as to prevent the ring section 20 of the annular work W from encountering undesirable deformation during the first and/or second steps. In place of moving the press roller 46 in the axial direction, a press roller having a length sufficiently covering the whole axial length of the internal spline ring section 10 of the internal spline ring 8 may be employed. In this case, while the press roller is fixed in the axial direction, only the mandrel 7 is moved in the axial direction.

It is to be understood that the present invention may be embodied with various changes, modifications and improvements, which may occur to those skilled in the art, without departing from the spirit and scope of the invention defined in the following claims.

What is claimed is:

1. A method for forming an internal spline annular ring having an internal root circle diameter and an internal tip diameter by use of an externally splined mandrel having an external tip diameter equal to said internal root circle diameter which is formed so as to supplementarily mate with said internal spline annular ring, said internal spline forming method comprising the steps of:

preparing a half-finished annular member having an internal diameter smaller than said external tip diameter of an externally splined mandrel; and press-driving said mandrel axially into said half-finished annular member so as to form internal splines on said annular member while forcing a spline forming press roller to press radially said half-finished annular member against said mandrel, thereby forming an internal spline annular ring.

2. An internal spline forming method as defined in claim 1, and further comprising the step of rotating said half-finished annular member while press-driving said mandrel axially into said half-finished annular member and pressing radially said half-finished annular member against said mandrel.

3. An internal spline forming method as defined in claim 2, wherein said spline forming press roller presses radially said half-finished annular member against said mandrel partly in a direction in which said mandrel is driven into said half-finished annular member and is axially moved along the entire axial length of said half-finished annular member together with said mandrel.

4. An internal spline forming method as defined in claim 2, wherein said spline forming press roller presses said half-finished annular member over the entire axial length of said half-finished annular member.

5. An internal spline forming method as defined in claim 2, wherein said spline forming press roller is brought into press contact with said half-finished annular member at commencement of rotation of said half-finished annular member.

6. An internal spline forming method as defined in claim 1, and further comprising the step of inserting a cylindrical core rod having an external diameter smaller than said internal tip diameter axially into an annular member mounted on a work mount member, and pressing radially said annular member against said cylindrical core rod so as to reduce said annular member in internal diameter, thereby provide said half-finished annular member.

7. An internal spline forming method as defined in claim 6, wherein said annular member has an internal diameter between said internal tip diameter of said internal spline ring and said external diameter of said cylindrical core rod.

8. An apparatus for forming an internal spline annular member having an internal root circle diameter and an internal tip diameter, said internal spline forming apparatus comprising:

a frame;

work mount means, supported for rotation by said frame, for mounting a half-finished annular member finished so as to have an internal diameter smaller than said internal root circle diameter thereon and rotating said half-finished annular member about an axis of said half-finished annular member;

an externally splined mandrel, supported for axial movement by said frame, which has an external tip diameter equal to said internal root circle diameter which is formed so as to supplementarily mate with said internal spline ring;

drive means, secured to said frame, for axially press-driving said externally splined mandrel into said half-finished annular member; and spline forming press means, supported by said frame, for radially pressing said half-finished annular member against said externally splined mandrel as said externally splined mandrel is axially press-driven into said half-finished annular member.

9. An internal spline forming apparatus as defined in claim 8, wherein said spline forming press means comprises a plurality of press rollers.

10. An internal spline forming apparatus as defined in claim 8, and further comprising a cylindrical core rod having an external diameter smaller than said internal tip diameter which is axially inserted into an annular member mounted on said work mount means and reducing press means for pressing radially said annular member against said cylindrical core rod so as to reduce said annular member in diameter, thereby providing said half-finished annular member.

11. An internal spline forming apparatus as defined in claim 10, wherein said cylindrical core rod is formed as an integral front section of said externally splined mandrel.

12. An internal spline forming apparatus as defined in claim 10, wherein said reducing press means comprises a plurality of press rollers.

13. An internal spline forming apparatus as defined in claim 10, wherein said annular member has an internal diameter between said internal tip diameter of said internal spline ring and said external diameter of said cylindrical core rod.

14. An internal spline forming apparatus as defined in claim 13, and further comprising coupling means for coupling said mandrel and said work mount means together.

15. An internal spline forming apparatus as defined in claim 14, wherein said coupling means comprises a spline key formed on one of said mandrel and said work mount means and a spline groove formed in another of said mandrel and said work mount means.

16. An internal spline forming apparatus as defined in claim 8, wherein said work mount means comprising a motor secured to said frame and a work mount attached to said motor for mounting said half-finished annular member.

17. An apparatus for forming an internal spline annular member having an internal root circle diameter and an internal tip diameter, said internal spline forming apparatus comprising:

a frame;

work mount means, supported for rotation by said frame, for mounting an annular member having an internal diameter smaller than said internal root circle diameter thereon and rotating said annular member about an axis of said annular member;

a mandrel, supported for axial movement by said frame, which comprises an externally splined core rod having an external tip diameter equal to said internal root circle diameter and formed so as to supplementarily mate with said internal spline ring, and a cylindrical core rod having an external diameter smaller than said internal diameter of said annular member;

drive means, secured to said frame, for axially moving said mandrel into said annular member; and press means for pressing radially said annular member against said cylindrical core rod to reduce said annular member in diameter as said cylindrical core rod moves in said annular member and against said externally splined core rod to form internal splines on said annular member reduced in diameter as said externally splined core rod moves in said annular member.

* * * * *